United States Patent [19]

Knox et al.

[11] Patent Number: 4,902,170

[45] Date of Patent: Feb. 20, 1990

[54] GROUTING METHOD - CHEMICAL METHOD

[75] Inventors: L. Carter Knox; Clayton A. Moore, both of Duncan, Okla.

[73] Assignee: Halliburton Company, Duncan, Okla.

[21] Appl. No.: 272,674

[22] Filed: Nov. 16, 1988

[51] Int. Cl.[4] ..... E02B 17/00

[52] U.S. Cl. ..... 405/225; 405/227

[58] Field of Search ..... 405/195, 224, 225, 227, 405/233; 166/292, 293

[56] References Cited

U.S. PATENT DOCUMENTS

| | | | |
|---|---|---|---|
| Re. 28,232 | 11/1974 | Bassett et al. | 405/227 |
| 3,468,132 | 9/1969 | Harris | 405/211 |
| 3,533,241 | 10/1970 | Bowerman et al. | 405/225 |
| 3,570,259 | 3/1971 | Thaxton | 277/5 |
| 3,702,537 | 11/1972 | Landers | 405/227 |
| 3,878,687 | 4/1975 | Tragesser, Jr. | 405/225 |
| 4,009,581 | 3/1977 | Britton et al. | 405/227 |
| 4,014,174 | 3/1977 | Mondshine | 405/233 |
| 4,047,391 | 9/1977 | Mayfield et al. | 405/225 |
| 4,052,861 | 10/1977 | Malone et al. | 405/195 |
| 4,063,421 | 12/1977 | Coone et al. | 405/225 |
| 4,063,427 | 12/1977 | Hoffman | 405/225 |
| 4,077,224 | 3/1978 | Coone | 405/225 |
| 4,140,426 | 2/1979 | Knox | 405/225 |
| 4,171,923 | 10/1979 | Landers | 405/225 |
| 4,181,454 | 1/1980 | Knox et al. | 405/227 |
| 4,275,974 | 6/1981 | Knox et al. | 405/225 |
| 4,310,265 | 1/1982 | Streich | 405/227 |
| 4,311,414 | 1/1982 | Baldridge | 405/227 |
| 4,493,592 | 1/1985 | Knox | 405/225 |
| 4,552,486 | 11/1985 | Knox et al. | 405/227 |

*Primary Examiner*—David H. Corbin

*Attorney, Agent, or Firm*—James R. Duzan

[57] ABSTRACT

An improved grouting method and arrangement using particulate material and aqueous solutions of alkali silicate materials confined between pile seal assembly and top of an offshore platform in sealing the annular space formed between either a jacket leg or pile sleeve and a pile driven therethrough or similar annular space of an offshore platform to support a column of grout thereon so that the annular space may ultimately be filled with grouting material.

17 Claims, 2 Drawing Sheets

GROUTING METHOD - CHEMICAL METHOD

BACKGROUND OF THE INVENTION

This invention relates to an improved grouting method for grouting the annular space between either the jacket leg or pile sleeve and a pile driven therethrough or any similar annular shape of an offshore platform used in well drilling and production using particulate material and an initial amount of alkali silicate material confined above a pile seal assembly on either the jacket leg or pile sleeve having a pile driven therethrough to support a column of grout in the annular space located above the pile seal assembly.

The prior art teaches several different methods of grouting the annular space formed between either a jacket leg or pile sleeve and a pile driven therethrough of offshore platforms. Typically, the methods involve setting a grout plug or column of grout which is supported either by the bottom of the body of water upon which the platform is installed or on a grout seal and subsequently filling the annular space above the plug with grouting material. Such typical prior art grouting methods are illustrated in U.S. Pat. Nos. Re. 28,232; 3,468,132; 3,878,687; 4,009,581; 4,047,391; 4,052,861; 4,063,421; 4,063,427; 4,077,224; 4,140,426; 4,171,923; and 4,275,974.

However, should such a grout plug or column not be supported by either a grout seal or bottom of the body of water, the grout will merely run out the bottom of the annular space into the surrounding water or area. Also, if some way of sealing the annulus cannot be found so that a grout plug or column can be placed in the annulus and allowed to harden, the annulus cannot be filled with grouting thereby affecting the stability of the offshore platform.

Previously, when trying to seal the annular space a wide variety of materials have been used. Typically, fast setting gypsum cements have been tried, lost circulation materials used in well drilling have been tried, etc. In some instances where the annular space is accessible, divers have sealed or tried to seal the annular space by filling it from the bottom with sacks, rags, rubber materials, etc.

However, the use of fast setting gypsum cements can plug up flow lines, lost circulation materials used in well drilling operations have not proven satisfactory since they are usually not capable of bridging large open areas, and the use of divers is expensive.

In wells, to consolidate the surface of a borehole in an incompetent formation and strengthen the bond between the surface of the borehole and cement placed therein the prior art teaches the method of forcing a multivalent cation salt into the formation, thereafter forcing an alkali metal silicate solution which has a pH less than 12.0 containing at least 12% by weight silica into the formation, and thereafter forcing an aqueous cement slurry containing at least 2% by weight of a water soluble multivalent cation salt to contact the surface of the borehole. Such a prior art method is disclosed in U.S. Pat. No. 4,014,174.

Another prior art method of grouting the annulus between either a jacket leg or pile sleeve and pile driven therethrough of an offshore platform uses alkali silicate materials to initially seal the annulus to support a column of grout thereon so that the annular space may ultimately be filled with grouting material. Such a method is described in U.S. patent application Ser. No. 425,346, filed on Sept. 28, 1982, now U.S. Pat. No. 4,493,592, assigned to the assignee of the present invention.

Yet another prior art improved method of grouting the annulus between either a jacker leg or pile sleeve and a pile driven therethrough of an offshore platform uses aqueous solutions of alkali silicate materials confined between a pair of pile seal assemblies in sealing the annular space formed between either a jacker leg or pile sleeve and a pile driven therethrough or similar annular sleeve space of an offshore platform to support a column of grout thereon so that the annular space may ultimately be filled with grouting material. Such an improved method and apparatus is described in U.S. Pat. No. 4,552,486, assigned to the assignee of the present invention.

Typical pile grout seals of the mechanical, non-inflatable type or pile wipers used in offshore platforms are shown in U.S. Pat. Nos. 3,533,241; 3,570,259; 3,702,537; 4,047,391; 4,181,454; 4,310,265; and 4,311,414.

STATEMENT OF THE INVENTION

The present invention is directed to an improved grouting method using particulate material and aqueous solutions of alkali silicate materials confined above a pile seal assembly in sealing the annular space formed between either a jacket leg or pile sleeve and a pile driven therethrough or similar annular space of an offshore platform to support a column of grout thereon so that the annular space may ultimately be filled with grouting material.

BRIEF DESCRIPTION OF THE DRAWINGS

The present invention will be better understood when taken in conjunction with the following drawings wherein.

DESCRIPTION OF THE INVENTION

Figure 1:
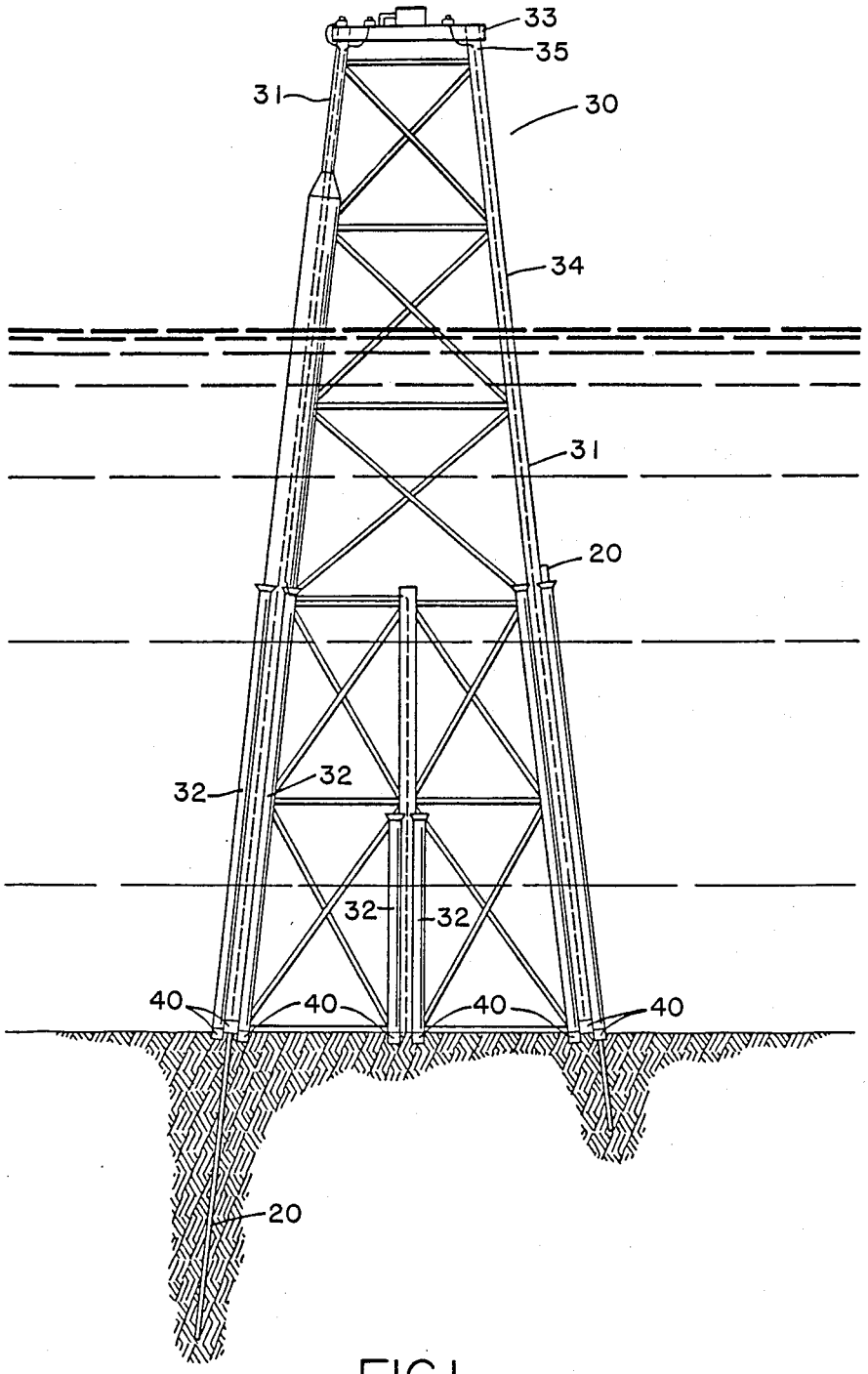
FIG. 1 shows a typical offshore platform having jacket legs and pile sleeves thereon having piling driven therethrough.

Referring to FIG. 1, an offshore platform 30 having a jacket portion 34, deck portion 33, jacket leg 31 and pile sleeve 32 is resting on the bottom of a body of water is shown having a seal assembly 40 installed on the bottom of each jacket leg 31 and pile sleeve 32. As shown, when installed, the platform 30 has the end of each jacket leg 31 and pile sleeve 32 embedded in the bottom of the body of water. Piles 20 are shown as being driven to depth through a jacket leg 31 and pile sleeve 32.

Figure 2:
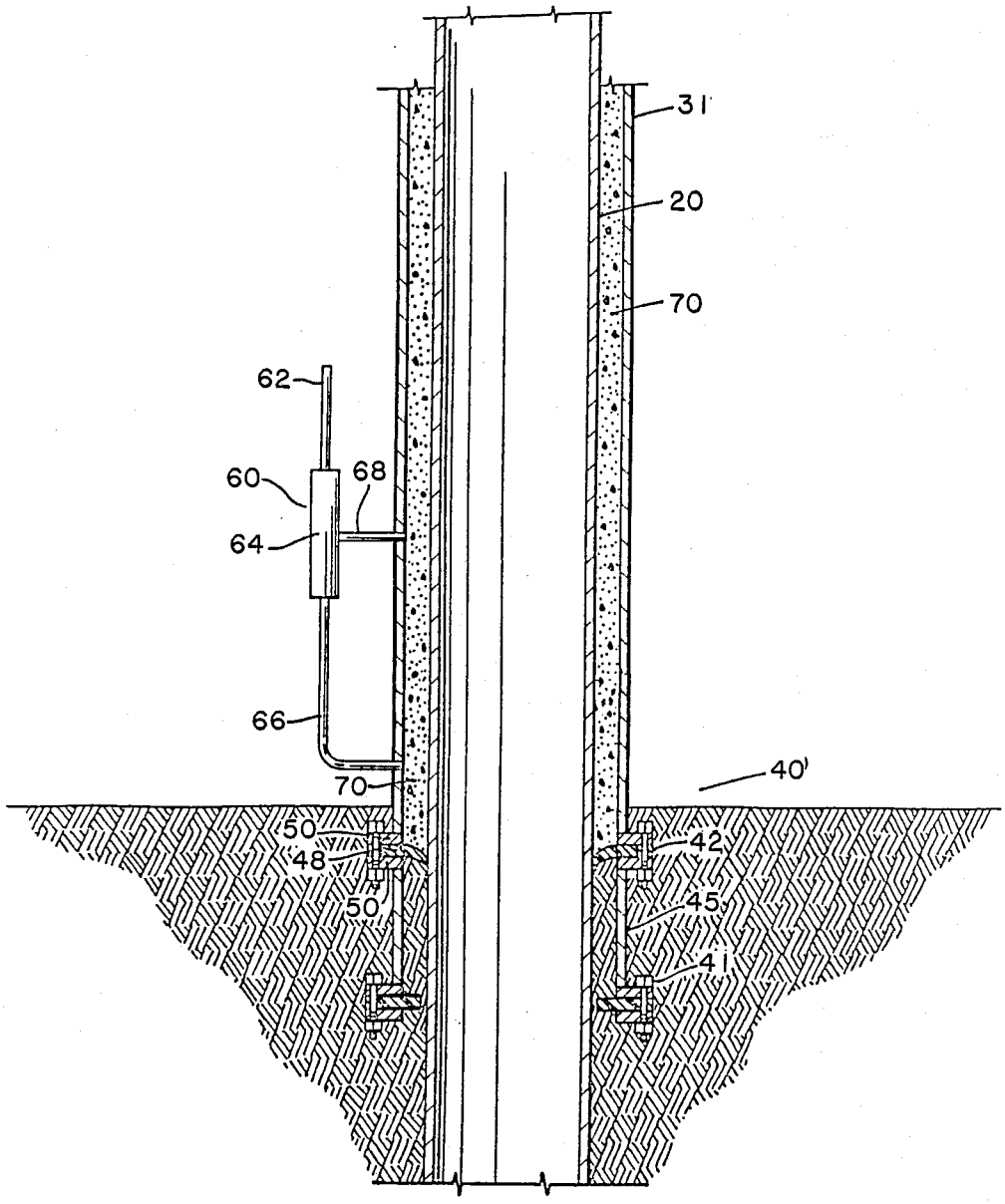
FIG. 2 shows the present invention in cross-section in leg or pile sleeve and a pile driven therethrough of an offshore platform.

Referring to FIG. 2, a seal assembly 40 which is used in the improved grouting method of the present invention is shown installed on an annular support member of the platform 30, such as a jacket leg 31, although it may be a pile sleeve 32, having a pile 20 driven therethrough.

The grouting arrangement of most typically to be used by the present invention comprises a seal assembly 40 having a grout seal or pile wiper assembly therein, a grout system 60 having a control valve 64, surface grout line 62 leading to the control valve, a first line 66 leading from the control valve 64 to the annular space 70 formed between jacket leg and pile driven therethrough adjacent the grout seal or pile wiper assembly and a second line 68 leading from the control valve to the annular space 70 between the jacket leg and pile driven therethrough higher above the grout seal or pile wiper assembly.

The seal assembly 40 comprises diaphragm assembly 41, pile seal assembly 42 and annular housing 45 connecting diaphragm assembly 41 and seal assembly 42. For the purposes of clarity herein, the term pile seal assembly 42 will refer to either a grout seal or pile wiper seal assembly, such as disclosed in the prior art described hereinbefore, or other such suitable means for enclosure of material.

The diaphragm assembly 41 comprises an elastomeric diaphragm member which has been pierced by pile 20 being retained on the jacket leg 31 by means of annular flanges secured to housing 45.

The pile seal assembly 42 comprises an annular elastomeric pile seal member 48 which sealingly engages the exterior of pile 20 being retained on the jacket leg 31 by means of annular flanges 50.

While the diaphragm assembly 41 has been shown as connected to the pile seal assembly 42 by housing 45, the housing 45 may be eleminated and the diaphragm and pile seal member stacked between the annular flanges 50.

The grouting system 60 on the jacket leg 31 comprises a surface grout line 62 running from the surface of the offshore platform to a location adjacent the lower end of the jacket leg 31 and a control valve 64 which communicates with annular space 70 formed between jacket leg 31 and pile 20 via lower line 66 and upper line 68.

The control valve 64 may be of any suitable commercially available valve which is capable of alternately directing fluid flow between annular space 70 via lines 66 and 68 respectively; however, a ball actuated single sleeve sliding valve such as shown in U.S. Pat. No. 4,275,974 is preferred.

The improved grouting method of the present invention makes use of particulate material and other material that can be pumped into annular space 70 to seal the space, have great enough load bearing strength to support in conjunction with pile seal member 48 an initial grout column in annular space 70, and that will not plug the grout line 62 after pumping the material therethrough leaving the grout line 62 suitable for further use.

The improved grouting method of the present invention which makes use of such particulate material and other material and comprises initially pumping or injecting a small fresh water spacer down the grout line 62 into the annular space 70, subsequently pumping or injecting particulate material down the grout line 62 into annular space 70, subsequently pumping or injecting an alkali silicate material which floculates upon contact with di- or multivalent cation fluids down the grout line 62 into the annular space 70 then actuating the valve 64 to prevent flow therefrom via line 66 while allowing flow therefrom via line 68 into annular space 70, next pumping or injecting a fresh water spacer of any desired amount into annular space 70 to clear any remaining alkali silicate material from line 62, control valve 64 and line 68 and subsequently pumping or injecting any suitable cement or grouting material down the grout line 62 into annular space 70 via line 68. If desired, a spacer fluid containing di- or multivalent cations, such as a potassium chloride solution, calcium chloride solution, etc., may be pumped into the annular space 70 before the initial fresh water spacer to provide a higher concentration of di- or multivalent cations in the annular spacer 70 with which the alkali silicate material may react.

It should be understood that the amount of fresh water in the initial fresh water spacer should be small in comparison to the volume of annular space 70 so that the annular space 70 remains substantially filled with sea water or a di- or multivalent cationic fluid with which the alkali silicate material is to react. The function of the first fresh water spacer being to prevent floculation of the alkali silicate material with sea water contained in line 62, control valve 64 and line 66 before the entry of the alkali silicate material into annular space 70. Similarly, the function of the second fresh water spacer being to prevent floculation of the alkali silicate material remaining in line 62, control valve 64 and any which may have entered into line 68 while the material is being flushed from line 62, control valve 64 ad line 68 to facilitate the injection of cement or grout into annular space 70.

If desired, in addition to the initial amount of particulate material pumped into the annular space 70 to fill tears in the pile seal member 48 and/or bridge gaps between the pierced diaphragm and pile 20, additional sand, high strength synthetic fibers such a polypropylene fibers, cellulose flakes, ground walnut shells, and other types of lost circulation materials as well as various types of cement may be included or mixed with the alkali silicate material to increase its strength thereby increasing the amount of grout column the alkali silicate material will support in conjunction with pile seal member 48 in the annular space 70 during the grout injection portion of the improved grouting method.

If the alkali silicate material in conjunction with the pile seal member 48 will not support a grout column in annular space 70 to completely fill the annular space 70 to the top of the jacket leg portion 34, after the initial grout in annular space 70 has hardened or set, a second injection of grout material into annular space 70 may be made to fill the annular space 70 from any convenient point on the jacket leg 31, such as from the top 35 thereof.

Also, if desired, the top of the jacket leg 31 may be sealed and compressed air or gas may be injected into the annular space 70 between the jacket leg 31 and pile 20 extending therethrough to expell water from annular space 70 past pile seal 48 and the diaphragm of diaphragm assembly 41 into the sea floor so that the annular space 70 is substantially free of water before the injection of any material thereinto. However, if the water is expelled from annular space 70, unless the alkali silicate material is mixed with di- or multivalent cation fluid before the pumping thereof into the annular space 70 which mixing will increase the pumping pressure required to pump the material into annular space 70, it will be necessary to inject di- or multivalent cation fluid into the annular space 70 to floculate the alkali silicate material pumped thereinto.

If desired, alternately, the particulate material and the alkali silicate material may be pumped into the annular space 70 and any residual sea water in the annular space 70 and any subsequent sea water leaking past pile seal member 48 and/or grout or cement in the annular space 70 may cause sufficient floculation of the alkali silicate material in annular space 70.

The improved grouting method of the present can be used to seal the annulus between either a jacket leg or pile sleeve and a pile driven therethrough utilizing any type pile seal member 48 therein; or, any other annulus of an offshore platform where it is desired to support the pressure of a column of cement or grout. Since the particulate material and alkali silicate material taken in conjunction with the pile seal member 48 has load bearing capabilities sufficient to support a substantial column of grout in the annulus 70, in many instances, the improved grouting method and arrangement effectively eliminates the need for an inflatable type grout seal at the bottom of jacket leg 31 in many instances thereby allowing a less expensive grout seal or pile wiper to be substituted therefore.

In those instances where the jacket leg 31 is not embedded in or resting on the floor of the body of water in which the platform is installed or the floor of the body of water is too soft or such a soft and muddy bottom to give effective bearing support, the pierced diaphragm, particulate material, and other material between the diaphragm and pile seal member 48 will help support the floculated alkali silicate material in annular space 70.

The preferred particulate material to be injected into the annular space 70 to bridge any tears in the pile seal member 48 or bridge gaps between the pile seal member 48 and pile 20 prior to the injection of alkali silicate material into the annular space 70 is sand, although any readily available particulate material which may be easily pumpled through the flow lines 62 and 66 and which has a specific gravity greater than sea water, such as sintered bauxite, shot, etc., may be used.

The preferred alkali silicate material which floculates upon contact with di- or multivalent cation fluid or sea water to be used in the improved method of grouting of the current invention is an aqueous sodium silicate solution sold under the trademark FLO-CHEK® Chemical A additive by Halliburton Services, a division of Halliburton Company.

An alternate material which can be used in the improved method of grouting of the present invention when mixed into an aqueous solution is a powdered silicate having a high ratio of silicon dioxide to alkali metal oxide sold under the trademark FLO-CHEK® P additive by Halliburton Services, a division of Halliburton Company.

When using the preferred material, FLO-CHEK® Chemical A additive, in the improved method of grouting and arrangement of the present invention, any desired amount of material may be pumped or injected into the annulus to be grouted depending upon the strength required to support the desired column of cement or grout to be injected into the leg to form a plug or fill the annulus. Therefore, the length of the housing above the pile seal member 48 into which FLO-CHEK® Chemical A additive is pumped or injected into the annular space 70 to be filled should be preferably at least four (4) feet of axial length of the annular space 70, to be sufficient to support an adequate column of cement or grout to be injected into the annular space 70 above pile seal member 48.

Although FLO-CHEK® Chemical A additive or FLO-CHEK® P additive are the preferred materials to be used in the improved grouting method of the present invention, any alkali silicate having a molar ratio of silicon dioxide ($SiO_2$) to alkali metal oxide (sodium, potassium, ammonium or lithium) between approximately 1.6 or less to 4.0 may be used.

Also, although it is preferred to use an initial spacer of fresh water before the injection of the alkali silicate material and spacer of fresh water after the injection of the alkali silicate material, the fresh water spacers may be eliminated, if the alkali silicate material can be prevented from floculating during pumping through the grout line 62, grout control valve 64 and lines 66 or 68 before entering the annular space 70.

It will be obvious to those skilled in the art that such an improved grouting method and grouting arrangement may be modified to be used on a wide variety of marine structures in various locations thereon where it is desired to seal an annular space and grout the area located thereabove, such modifications being within the scope of the present invention.

Having thus described our invention, we claim:

1. A method of grouting an annular space formed by an annular support member having an pile seal assembly thereon and a pile driven therethrough of an offshore platform, said annular space being located between said annular support member and said pile, said method comprising the steps of:

injecting particulate material into said annular space above said pile seal assembly;

injecting an alkali silicate material which floculates upon contact with a di- or multivalent cation fluid into said annular space above said pile seal assembly; and injecting cement or grout into said annular space above said pile seal assembly.

2. The method of grouting of claim 1 wherein said alkali silicate material is selected from a group consisting of aqueous sodium silicate, aqueous potassium silicate, aqueous ammonium silicate and aqueous lithium silicate.

3. The method of grouting of claim 1 further comprising the steps of:

injecting a spacer of fresh water into said annular space above said pile seal assembly before the step of injecting an alkali silicate material thereinto; and injecting a spacer of fresh water into said annular space above said pile seal assembly after the step of injecting the alkali silicate material into the annular space.

4. The method of grouting of claim 1 further comprising the step of:

injecting a spacer of di- or multivalent cation fluid into said annular space above said pile seal assembly before the step of injecting an alkali silicate material thereinto.

5. The method of grouting of claim 1 wherein said alkali silicate material is an aqueous solution of FLO-CHEK® additive.

6. The method of grouting of claim 1 wherein said annular support member comprises a jacket leg of said offshore platform.

7. The method of grouting of claim 1 wherein said annular support member comprises a pile sleeve of said offshore platform.

8. A method of grouting an offshore platform having a jacket portion including jacket legs thereon, each jacket leg having a pile driven therethrough forming an annulus between said jacket leg and pile, and a deck portion attached to the top of the jacket portion, a diaphragm assembly, a pile seal assembly forming an annular space between said jacket leg and pile and the top of said jacket leg, and a grout system including a first grout line extending from the top of said jacket leg to adjacent the bottom thereof, a grout control valve having the inlet thereof connected to the first grout line, a first valve outlet line connected to said annular space and a second valve outlet line connected to said annular space above said first valve outlet line, said method of grouting comprising the steps of:

injecting particulate material into said annular space through said grout line, grout control valve and first valve outlet line;

injecting an alkali silicate material which floculates upon contact with di- or multivalent cation fluid into said annular space through said grout line, grout control valve and first valve outlet line; and injecting cement or grout into said annular space through said grout line, grout control valve and second valve outlet line.

9. The method of grouting of claim 8 wherein said alkali silicate material is selected from a group consisting of aqueous sodium silicate, aqueous potassium silicate, aqueous ammonium silicate and aqueous lithium silicate.

10. The method of grouting of claim 8 further comprising the step of:

actuating said grout control valve after the step of injecting an alkali silicate material into said annular space to prevent flow to said annular space and to permit flow to said annular space through said second valve outlet line.

11. The method of grouting of claim 8 further including the step of:

flowing water from said annular space to permit the injection of alkali silicate material into said annular space.

12. The method of grouting of claim 11 wherein water flowing from said annular space flows therefrom through the bottom of said jacket leg past the pile seal of said pile seal assembly and the diaphragm of said diaphragm assembly.

13. The method of grouting of claim 8 further comprising the steps of:

injecting a spacer of fresh water into said annular space before the step of injecting an alkali silicate material thereinto; and injecting a spacer of fresh water into said annular space above said first valve outlet line after the step of injecting the alkali silicate material into annular space.

14. The method of grouting of claim 8 further comprising the step of:

injecting a spacer of di- or multivalent cation fluid into said annular space before the step of injecting an alkali silicate material thereinto.

15. The method of grouting claim 1 or 8 wherein the particulate material is sand.

16. The method of grouting of claim 1 or 8 wherein the particulate material is sintered bauxite.

17. The method of grouting of claim 1 or 8 wherein the particulate material is shot.

* * * * *